US005802648A

United States Patent [19]

Neun et al.

[11] Patent Number: 5,802,648

[45] Date of Patent: Sep. 8, 1998

[54] APPARATUS AND METHOD OF FABRIC CLEANING

[75] Inventors: John A. Neun, Clifton Park; Peter T. Carstensen, Adirondack, both of N.Y.; Salvatore C. Panarello, Sewell, N.J.

[73] Assignee: Thermo Fibertek Inc., Waltham, Mass.

[21] Appl. No.: 498,909

[22] Filed: Jul. 6, 1995

[51] Int. Cl.[6] ..... D06B 5/02

[52] U.S. Cl. ..... 8/151; 8/158; 68/62; 68/205 R; 162/272; 162/275

[58] Field of Search ..... 8/151, 158; 68/205 R, 68/62; 134/122 R; 162/272, 277, 274, 275; 239/101; 222/399

[56] References Cited

U.S. PATENT DOCUMENTS

| | | | |
|---|---|---|---|
| 1,401,376 | 12/1921 | Thompson | 68/206 R |
| 1,417,587 | 5/1922 | Tully . | |
| 1,540,454 | 6/1925 | Ayers . | |
| 1,550,993 | 8/1925 | Vickery . | |
| 1,771,144 | 7/1930 | Ruhe . | |
| 2,532,471 | 12/1950 | Wedler . | |
| 2,595,933 | 5/1952 | Gilbertsen | 68/205 R |
| 2,900,991 | 8/1959 | Arnold | 68/205 R |
| 3,123,994 | 3/1964 | Brown et al. | 68/205 R |
| 3,163,030 | 12/1964 | Woodworht, Jr. | 68/205 R |
| 3,177,505 | 4/1965 | Brown et al. | 68/205 R |
| 3,205,686 | 9/1965 | Norton . | |
| 3,279,976 | 10/1966 | Eagle . | |
| 3,292,228 | 12/1966 | Tigner . | |
| 3,521,820 | 7/1970 | Cooley | 239/101 |
| 3,589,147 | 6/1971 | Price, Jr. . | |
| 3,611,757 | 10/1971 | Hills . | |
| 3,717,015 | 2/1973 | Spencer | 68/205 R |
| 3,739,483 | 6/1973 | Weier-Windhorst . | |
| 3,830,691 | 8/1974 | Truesdale . | |
| 3,910,815 | 10/1975 | Shelor . | |
| 3,966,544 | 6/1976 | Johnson . | |
| 4,167,440 | 9/1979 | Falk . | |
| 4,540,469 | 9/1985 | Lundstrom . | |
| 4,598,238 | 7/1986 | Scarano . | |
| 4,605,472 | 8/1986 | Nakamura . | |
| 4,701,242 | 10/1987 | Scarano . | |
| 4,753,712 | 6/1988 | Martin . | |
| 4,777,972 | 10/1988 | Adam . | |
| 4,880,499 | 11/1989 | Pikulik . | |
| 4,923,743 | 5/1990 | Stewart . | |
| 4,931,140 | 6/1990 | Peltola . | |
| 4,967,456 | 11/1990 | Sternlieb et al. | 68/205 R |
| 4,995,944 | 2/1991 | Aston . | |
| 5,136,761 | 8/1992 | Sternlieb et al. | 68/205 R |
| 5,223,097 | 6/1993 | Hassler . | |
| 5,282,575 | 2/1994 | Krulick . | |
| 5,378,308 | 1/1995 | Thoms | 134/122 R |
| 5,381,592 | 1/1995 | Higgins . | |
| 5,457,845 | 10/1995 | Higgins . | |
| 5,491,857 | 2/1996 | Love, III . | |

FOREIGN PATENT DOCUMENTS

| | | |
|---|---|---|
| 452163 | 10/1991 | European Pat. Off. . |
| 342519 | 2/1931 | United Kingdom . |
| 952819 | 3/1964 | United Kingdom . |

*Primary Examiner*—Frankie L. Stinson
*Attorney, Agent, or Firm*—Kane, Dalsimer, Sullivan, Kurucz, Levy, Eisele and Richard, LLP

[57] ABSTRACT

A method and apparatus for cleaning dryer fabrics and the like comprising an ultra high pressure water jet or jets at reduce water volume.

12 Claims, 2 Drawing Sheets

APPARATUS AND METHOD OF FABRIC CLEANING

FIELD OF INVENTION

The present invention is directed towards an apparatus and method of cleaning fabric, particularly fabric used in papermaking.

BRIEF DESCRIPTION OF THE PRIOR ART

In papermaking, endless belts, fabric, or screens are used to support the paper sheet while allowing water to be removed in the formation of paper. The dryer wires or screens used in papermaking through normal use become contaminated by impurities from interaction with the paper sheet. This reduces the screens permeability to air which results in a reduction of the screen's water and air handling capacity and possibly paper quality. Accordingly, to maintain a steady state operation it is necessary to keep the screen free from such impurities.

Historically, dryer screen cleaning has been done on a batch wash basis during machine shut downs using conventional showers. Such batch wash type of cleaning while the machine is producing paper is not possible since the excessive amount of water required would upset the drying process. Continuous dryer screen cleaning has been used by using showers that traverse the fabric with a single jet resulting in substantially reduced water usage as compared to a conventional shower. The nozzles employed are of standard design with an aperture on the order of 1 mm or slightly less which is similar to that used in conventional showers. The showers operate at conventional pressures on the order of 100–300 PSI. The effect of adding water to the process at this point can be further reduced by adding an air jet to remove the water from the fabric, heating the water, or locating the shower as far upstream in the fabric return loop as possible. In some cases, these techniques can not be used due to various restrictions but even with all of the above improvements, continuous cleaning of dryer screens is only feasible in grades that are less sensitive to streaking.

One suggested method of cleanings is set forth in U.S. Pat. No. 4,540,469. In this regard this patent suggests increasing the pressure of the water while maintaining the orifice size. It is stated that the increased velocity resulting from such a change, although resulting in a corresponding increase in water flow, will result in less water remaining in the fabric since more of the water passes through the drying wire. The nozzle size can be reduced in such a way that the total water flow is maintained at conventional levels with satisfactory results in a pressure range of 430 to 1300 PSI. The patent teaches that reducing the water flow further is disadvantageous because of the reduction in cleaning effect caused buy the narrower stream. The patent also teaches that the volume of water used at higher pressures is optimal if it increases with pressure since the higher amount of water used improves the cleaning but the water remaining in the fabric is maintained constant. This follows the conventional belief that cleaning is a function of water flow. Following this guideline, the water retained in the fabric can only be reduced by a factor which results from water carried through the fabric rather than deposited on it.

In the current cleaning of paper machine fabrics as aforesaid liquid jets or fans are sprayed onto the fabric. These jets rely on mechanical energy of the stream to dislodge contaminants, liquid flow to flood contaminants from the fabric, or chemical action to dislodge or loosen contaminants. This system has proved satisfactory in its general application in paper making. However, in the dryer section of the paper machine it can be problematic because the sheet is dry enough to be more sensitive to discontinuities of moisture in the fabric. If too much water is used to clean a dryer fabric, efficiency of the dryer is compromised. If only a single point of water is applied, the sheet can become streaked by the moisture streak left in the fabric by the shower. Typically, the single jet shower is used in conjunction with an air jet to drive the water from the fabric, but this approach is often inadequate.

Accordingly, it is desirable to improve upon the cleaning of screens, particularly dryer screens, which provides for efficient cleaning yet reduces or eliminates streaking.

SUMMARY OF THE INVENTION

It is therefore a principal object of the invention to provide for an improved means of cleaning fabric in a papermaking machine.

It is a further object to provide for such cleaning which precludes or reduces streaking or otherwise effects the quality of the paper. It is a further object to provide for such cleaning in dryer fabrics particularly, and fabrics generally. A yet further object is to provide for such cleaning by utilizing reduced water usage, and water retained in the fabric.

These and other objects are achieved by the present invention's use of ultra high pressure water jet(s) in the cleaning of paper maker's fabrics. In this regard, unlike conventional thinking which teaches that cleaning is dependent upon having both as large as possible nozzle size and as high a pressure as practical, cleaning and damage are related to the energy density of the stream applied to the fabric. A stream of fluid can be characterized in terms of the size of the hole producing the stream and the pressure of the fluid behind the hole. For needle jet type showers, these parameters can be directly translated to the fluid's mass flow rate and velocity. When such a stream impacts an object like a dryer screen, the force generated by the stream's impact is proportional to the product of the mass flow rate and velocity and the power generated is proportional to the mass flow rate times the velocity squared. If integrated over time, power becomes energy. Therefore adequate cleaning can be obtained using substantially reduced mass (water flow) provided that the velocity of the stream is increased proportionally. Damage to the fabric will not be increased provided that the total energy density (power times time divided by area) is not increased. Reducing the hole size of the nozzle will allow the flow rate to be reduced while increasing the pressure to achieve higher velocity. Cleaning and damage can thus be balanced by controlling energy application with greatly reduced water flow since the power increases with the square of velocity.

BRIEF DESCRIPTION OF THE DRAWING

Thus by the present invention its objects and advantages will be realized, the description of which should be taken in conjunction with the drawings wherein.

DETAILED DESCRIPTION OF THE PREFERRED EMBODIMENT

The present invention provides for the effective cleaning of dryer fabrics or any other fabric while greatly reducing water streaks. It has been determined that the major effect of a water jet on a fabric where effect is measured as fabric damage or cleaning is proportional to the power applied to the fabric by the jet. Power is energy over time. Energy is ½ $mv^2$, that is, one half of the mass of the water times the square of its velocity as it impinges the fabric. When water flows through an orifice, its velocity is proportional to the square root of the pressure behind the nozzle. Mass flow is proportional to velocity and the area of the orifice. For example, a conventional shower might use a 0.040 in. diameter nozzle operating at 300 psi and apply about 40 watts to the fabric with a volume flow of 0.515 gpm. The present invention can apply an equivalent energy using much higher pressure and a much smaller orifice. For example, 40 watts can be achieved through a 0.010 inch diameter nozzle with a pressure of about 1600 psi, resulting in a volume flow of 0.067 gpm. This greatly reduced flow will preclude streaks.

Figure 1:
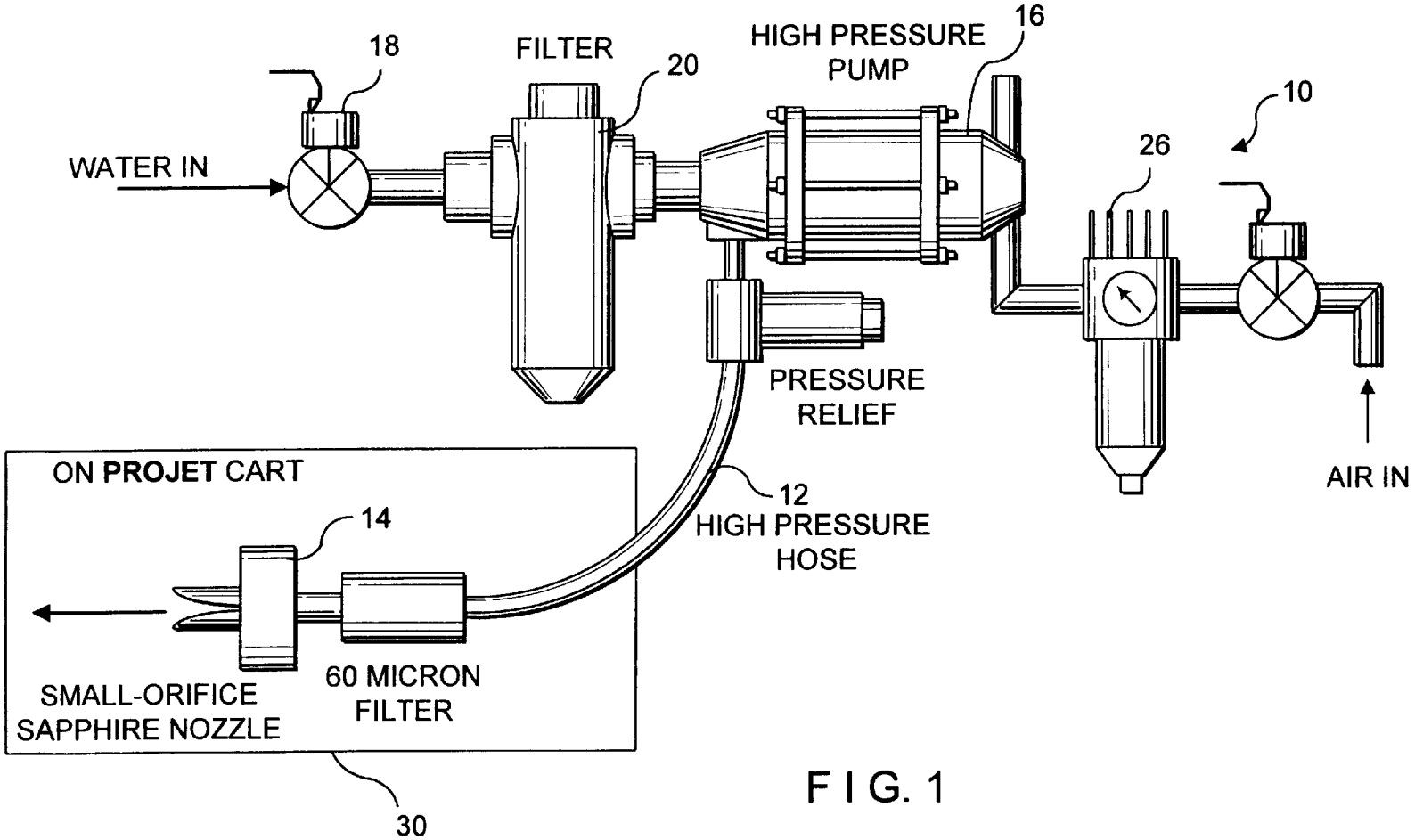
FIG. 1 is a perspective view of a high pressure pump and reduced nozzle for delivering the water to the nozzle for cleaning, incorporate the teachings of the present invention.

Turning now more particularly to the drawings, FIG. 1 is a schematic representation of the ultra high pressure (system 10) of the present invention. The system 10 may be implemented through appropriate modifications of the PROJET® shower currently available from AES Engineered Systems Inc., 436 Quaker Rd., P.O. Box 7010, Queensbury, N.Y. 12804. In general the PROJET® System provides for a shower for cleaning fabric particularly papermakers fabric. This comprises a jet or nozzle which traverses the fabric spraying water on the fabric. The typical nozzle speed is one nozzle diameter per revolution of the fabric. The PROJET® shower is modified to accept the present system in two ways: a high pressure hose 12 is substituted for the standard hose, and a small orifice sapphire nozzle 14 is used. A high pressure pump 16 pressurizes the water to the desired pressure, usually 1800 psi. This pressure 1800 psi provides a factor of reserve of 200 psi over the conventional 40 watts of cleaning power. A water inlet regulator 18 and filter 20 are coupled to pump 16 along with a pressure relief valve 22 between the pump 16 and nozzle 14. Also an air inlet regulator 24 is provided with air gauge 26 which is coupled to pump 16 to drive the same. Any pump of adequate volume and pressure capabilities can be used.

A fine filter 28 e.g. 60 microns is provided prior to the nozzle 14. The nozzle 14 is supported by a cart 30 which runs along a track 32 shown schematically in FIG. 2. An example of such a track arrangement is disclosed in U.S. Pat. No. 4,701,242, the disclosure of which is incorporated herein by reference.

At the aforesaid high pressure with the small diameter, it has been found that the effected area of cleaning of the high pressure nozzle 14 is at least three times its diameter. The nozzle can therefore be run at least three times the typical speed used in the PROJET® system, if desired.

Figure 2:
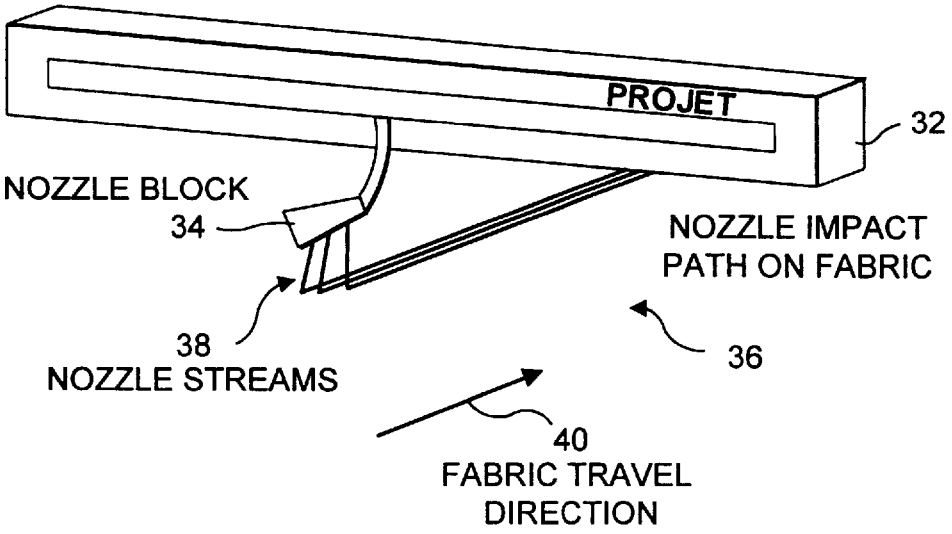
FIG. 2 is a somewhat schematic view of the cleaning of a fabric using a high pressure stream, incorporating the teachings of the present invention.

In FIG. 2 there is shown a second embodiment. In this embodiment three nozzles are maintained on a manifold 34. These are coupled to a cart (not shown) which runs along the track 32 which traverses the fabric 36. The streams 38 of fluid impacting the fabric 36 are shown. Arrow 46 indicates the travel directions of the fabric. While one nozzle can provide sufficient cleaning, the three nozzles provide a factor of safety for cleaning and provide the opportunity to speed the shower traverse rate if fabric cleaning differentials across the fabric face become a problem. The manifold 32 is mounted such that it can be rotated about an axis more or less perpendicular to the fabric 36. Rotation of the manifold 32 causes the spacing between nozzle paths to change. Nozzle alignment on the fabric can thus be adjusted. Even with three nozzles, a substantial advantage in applied volume over conventional pressure showering is provided. This invention can further be utilized on conventional oscillated showers, such as that described in U.S. Pat. No. 4,598,238 where the nozzles would be modified to be very small and pressure made very high, as previously described herein.

Thus by the present invention its objects and advantages are realized and although preferred embodiments have been disclosed and described in detail herein its scope should not be limited thereby, rather its scope should be determined by that of the appended claims.

What is claimed:

1. A method cleaning a fabric traveling in a direction through the effect of a water jet impacting thereon comprising the steps of:

providing a jet of water at a pressure of approximately 1600 psi and above whereupon a change in the amount of pressure of the jet allows a change in the mass and velocity of water used so that a desired amount of energy of the jet is maintained;

causing said jet of water to impact on a fabric which is to be cleaned; and moving said jet across said fabric in a direction substantially perpendicular to the direction of travel of the fabric.

2. The method in accordance with claim 1 which further includes the step of providing a nozzle having an orifice diameter of approximately 0.010 inches or less to create the jet of water.

3. The method in accordance with claim 1 which further includes the step of reducing the volume of water through the nozzle to approximately 0.07 gallons per minute or less.

4. The method in accordance with claim 1 which further includes the step of providing a plurality of jets of water impacting on the fabric.

5. An apparatus for cleaning a fabric traveling in a direction through the effect of a water jet impacting thereon comprising:

a nozzle having an orifice for creating a high pressure water jet;

a pressure means for creating a water pressure of approximately at least 1600 psi, said pressure means being coupled to the nozzle and supplies a high pressure flow of liquid at least 1600 psi thereto to create a water jet whereupon a change in the amount of pressure of the jet allows a change in the mass and velocity of water used so that a desired amount of energy of the jet is maintained;

means for allowing the nozzle to traverse a fabric in a direction perpendicular to the direction of travel of the fabric so as to allow the water jet to impact thereon for cleaning purposes.

6. The apparatus in accordance with claim 5 wherein said orifice is approximately 0.010 inches to create the jet of water.

7. The apparatus in accordance with claim 6 which includes means to regulate the volume of water supplied to the nozzle.

8. The apparatus in accordance with claim 7 wherein the volume of water supplied to the orifice at approximately 0.07 gallons per minute or less.

9. The apparatus in accordance with claim 8 which includes a plurality of orifices to create a plurality of high pressure water jets which impact the fabric for cleaning purposes.

10. The apparatus in accordance with claim 8 which includes an adjustable manifold on which said plurality of orifices are located which allows for adjusting the position of the impact of the water jets on the fabric.

11. The apparatus in accordance with claim 5 which includes a plurality of orifices to create a plurality of high pressure water jets which impact the fabric for cleaning purposes.

12. The apparatus in accordance with claim 10 which includes an adjustable manifold on which said plurality of orifices are located which allows for adjusting the position of the impact of the water jets on the fabric.

* * * * *